United States Patent [19]

Kildal et al.

[11] 4,394,990

[45] Jul. 26, 1983

[54] WEB CINCHING AND WINDING APPARATUS AND METHOD

[75] Inventors: Maurice A. Kildal, Webster; Stephen J. Hassall, Churchville, both of N.Y.

[73] Assignee: Eastman Kodak Company, Rochester, N.Y.

[21] Appl. No.: 218,592

[22] Filed: Dec. 19, 1980

[51] Int. Cl.[3] ..... B65H 17/08

[52] U.S. Cl. ..... 242/65

[58] Field of Search ..... 242/65, 66, 67.1 R, 242/18 DD, 74, 75.1, 56 R

[56] References Cited

U.S. PATENT DOCUMENTS

| | | | |
|---|---|---|---|
| 1,894,281 | 1/1933 | Parsons | 242/65 |
| 2,492,496 | 12/1949 | Nesbitt | 242/65 X |
| 3,291,405 | 12/1966 | O'Brien | 242/18 DD |
| 3,537,664 | 11/1970 | Mallie et al. | 242/66 |
| 3,585,779 | 6/1971 | Thayer | 242/67.1 R X |
| 3,692,252 | 9/1972 | Perconti | 242/66 |
| 3,884,427 | 5/1975 | Hashimoto et al. | 242/56.2 |
| 3,889,892 | 6/1975 | Melead | 242/65 X |
| 4,063,688 | 12/1977 | Grellier | 242/18 DD |
| 4,117,986 | 10/1978 | Hutzenlaub | 242/65 X |

FOREIGN PATENT DOCUMENTS

| | | | |
|---|---|---|---|
| 2432166 | 1/1976 | Fed. Rep. of Germany | 242/18 DD |
| 1117668 | 5/1956 | France | 242/18 DD |

*Primary Examiner*—John M. Jillions

*Attorney, Agent, or Firm*—Steve W. Gremban

[57] ABSTRACT

To cinch a web end portion onto a core, the core is center driven by a core driving mechanism at an outer peripheral speed in excess of the speed at which the web end portion is fed to and threaded around the core. After the web end portion is cinched onto the core and the web wound to form a roll of predetermined diameter, the core drive mechanism is disengaged from the core to terminate the core center drive. The outer surface of the roll further substantially simultaneously engages a roll surface drive mechanism which is normally spaced from the core for surface driving the roll.

15 Claims, 8 Drawing Figures

WEB CINCHING AND WINDING APPARATUS AND METHOD

BACKGROUND OF THE INVENTION

1. Field of the Invention

The present invention relates generally to web handling, and more particularly to a web cinching and winding apparatus and method. To cinch the web end portion onto a core, the core is center driven at an outer peripheral speed greater than the transport speed of the web end portion to be threaded around the core. After the web end portion is cinched onto the core and the web wound to form a roll of predetermined diameter, the core center drive is terminated, and substantially simultaneously the outer surface of the roll is surface driven.

2. Description of the Prior Art

U.S. Pat. No. 3,585,779 discloses a winding apparatus in which a web end portion is cinched onto a spool by rotatably driving the spool at an outer peripheral speed in excess of the speed at which the web end portion is threaded around the spool. After cinching, the web is wound onto the spool by continued driving of the spool, commonly referred to in the industry as center drive winding.

It is also known in the prior art, of which U.S. Pat. Nos. 3,537,664 and 3,692,252 are exemplary, to initially attach or fasten a web end portion onto a core, and then drive the outer surface of web convolutions on the core by means of a builder roller to form a roll. This means of winding a roll is commonly referred to in the industry as surface winding.

A web cinching device is disclosed in U.S. Pat. No. 3,884,427 wherein web cinching is achieved by an endless belt wrapper. A wrapping mechanism wraps a belt almost completely around the outer periphery of a core leaving a small gap between the belt and core into which a web end portion is fed. After the web end portion is cinched onto the core, the belt is withdrawn.

One of the problems with the center driven winding device is adequately controlling winding torque and web tension as the roll diameter increases, particularly where large rolls are wound. This has in instances necessitated the use of complicated and expensive control devices.

In surface driven winding devices, the web and core are traveling at the same speed. Since cinching a web end portion on a core can be defined as tightening a web by pulling on the web while holding the core (after the web end portion has entered the nip between the core and first web convolution) relative motion between the web and core is implied. Since relative motion between the web and core is not present in surface winding, cinching as defined above is unobtainable. In order to attach the web end portion to the core, means must be provided such as closely spaced threading guides, rollers or elastic bands surrounding the core to insure intimate contact of the web to the core. Such threading guides present problems, for example, of increased costs and reduced reliability due, among other things, to the precision required in manufacturing the parts, and the close tolerances involved in assembly and operation.

A problem with belt or band wrapping devices is difficulty of adjusting the device which is extremely critical. Improper adjustment of the belt wrapping device can result in web surface abrasion when the belts are around the core, and cinching failures with severe consequences. The belts further have to be replaced periodically.

SUMMARY OF THE INVENTION

A primary object of the present invention is to provide a web cinching and winding apparatus and method wherein web cinching and winding of web convolutions is initially achieved by center driving the core at a speed in excess of the web transport speed. After cinching and partial winding is achieved, the center driving of the core is terminated, and the web is wound on the roll by surface driving the roll.

The web cinching and winding apparatus for practicing the method of this invention comprises an outer core surface spaced from a roll drive surface on a builder roller. Means are provided for transporting a web end portion through the space between the core and roll drive surfaces and onto the core at one speed. The web end portion is threaded around the core by guide means. Core driving means are provided for center driving the core at an outer peripheral speed in excess of the web speed for automatically cinching the web end portion onto the core and winding a plurality of convolutions of web onto the core to form a roll. During the time that the core driving means is in its core driving position, the roll drive surface on the builder roller is in a roll disengaged position due to the aforementioned spacing between the core and roll drive surfaces. The core driving means and roll surface driving means are further responsive to the roll surface when it reaches a predetermined roll diameter for substantially simultaneously placing the core driving means in a core disengaged position for terminating center driving of the core, and placing the roll drive surface of the builder roller in driving engagement with the outer surface of the roll for surface winding the roll.

In more specific aspects of the invention, cinch shoes having surfaces spaced from and substantially conforming to the peripheral surface of the core are used for guiding the web end portion around the core. The builder roller adjacent the core has a peripheral drive member such as a tire of one diameter engageable with core support means for center driving the core. The roll drive surface of the builder roller is cylindrical, and of a smaller diameter than the tire to provide a space between the core and roll drive surfaces when the tire is in engagement with the core support means.

The primary advantages of the web cinching and winding apparatus of this invention are, for example, simplicity of design and construction, high speed winding roll capability, reliability in operation, and manufacturing economy. This is achieved by providing a roll drive surface spaced from the core surface, and initially center driving the core at a peripheral speed in excess of the transport speed of the web end portion being threaded around the core for cinching the web end portion onto the core. Once the web end portion is cinched and the roll is wound to a predetermined diameter, the center drive is terminated, and substantially simultaneously the roll is surface driven by the roll drive surface of the builder roller for winding the remaining web onto the roll.

The invention and its advantages will become more apparent from the detailed description of the invention presented below.

BRIEF DESCRIPTION OF THE DRAWINGS

In the detailed description of the invention presented below, reference is made to the accompanying drawings, in which.

DETAILED DESCRIPTION OF THE INVENTION

Figure 2:
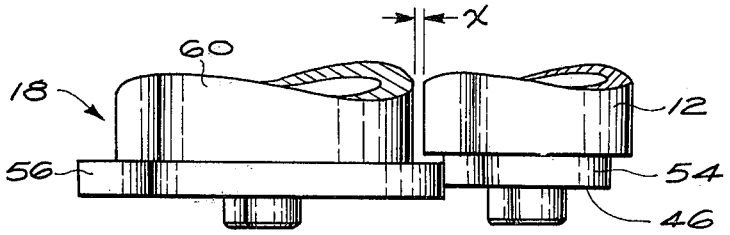
FIG. 2 is a segmental top plan view of a portion of the apparatus of FIG. 1.
Figure 1:
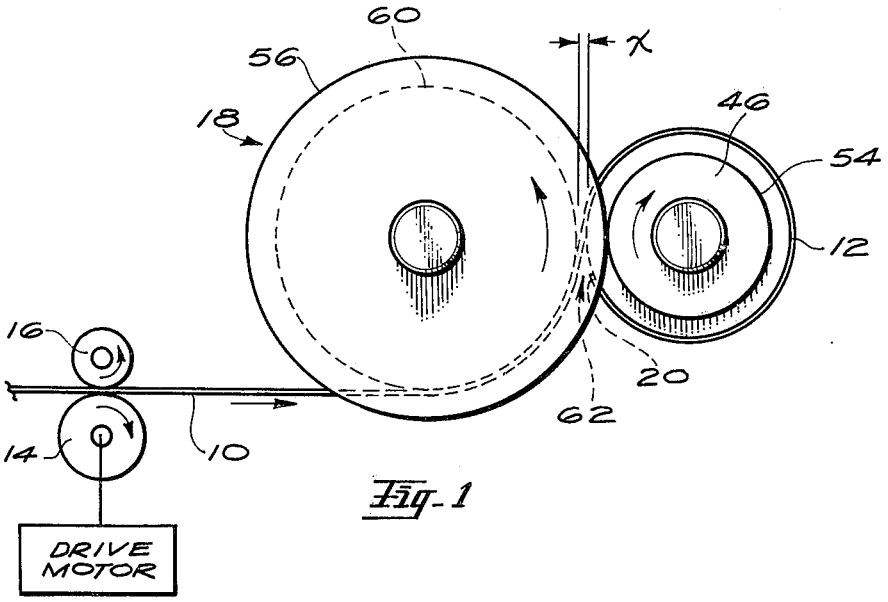
FIG. 1 is a segmental side elevational view of a builder roller, core and web transport rollers of a web cinching and winding apparatus of this invention in a core center driving mode of operation, with the support frame, drive motors and other mechanisms omitted for purposes of clarity.

Referring to FIGS. 1 and 2 of the drawings, a preferred embodiment of apparatus for cinching and winding a web 10 on a core 12 is illustrated. The web 10 of film, paper or the like is initially transported by a pair of motor driven pinch rollers 14, 16 at a selected speed partially around a driven builder roller 18 and around the periphery of core 12 where the leading web end portion 20 is cinched. After cinching, builder roller 18 center drives core 12 by means to be explained hereinafter to wind the web onto the core to form a roll. The pinch rollers 14, 16 are coupled to clutches, not shown, which separate when builder roller 18 has taken over the driving of the web.

Figure 3:
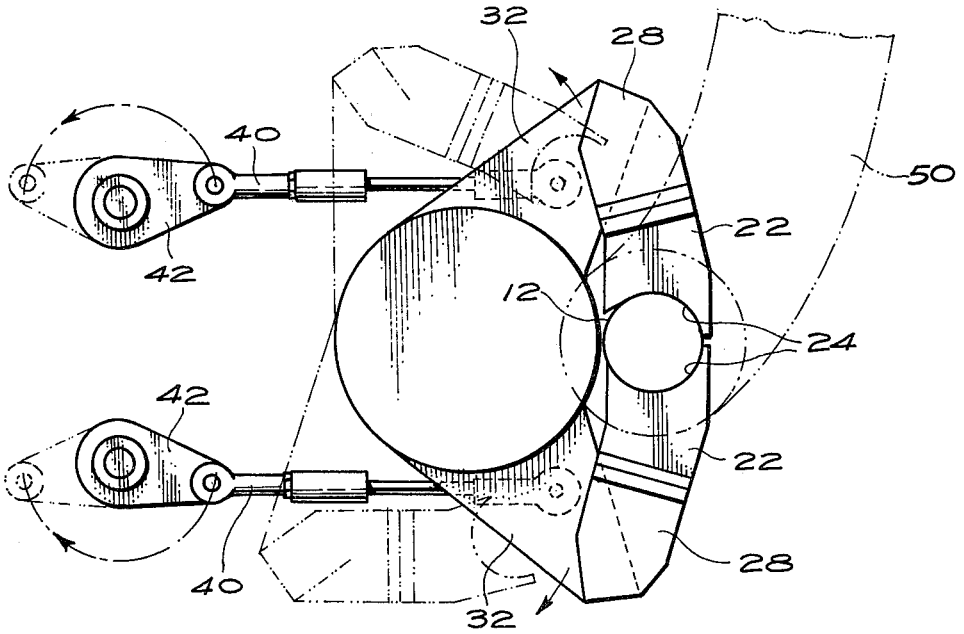
FIG. 3 is a side elevational view of the cinch shoe mechanisms for guiding a web around the core of the web cinching and winding apparatus.
Figure 5:
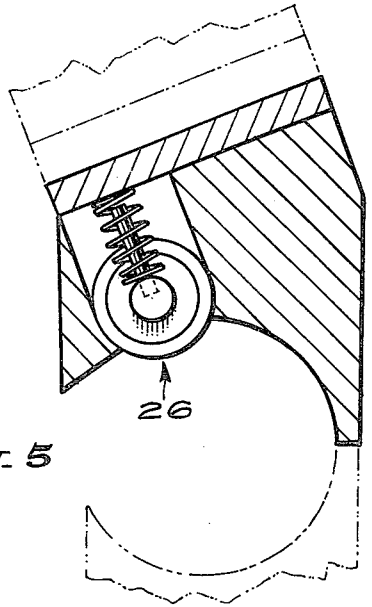
FIG. 5 is a segmental view in section of a portion of the upper and lower cinch shoes.
Figure 4:
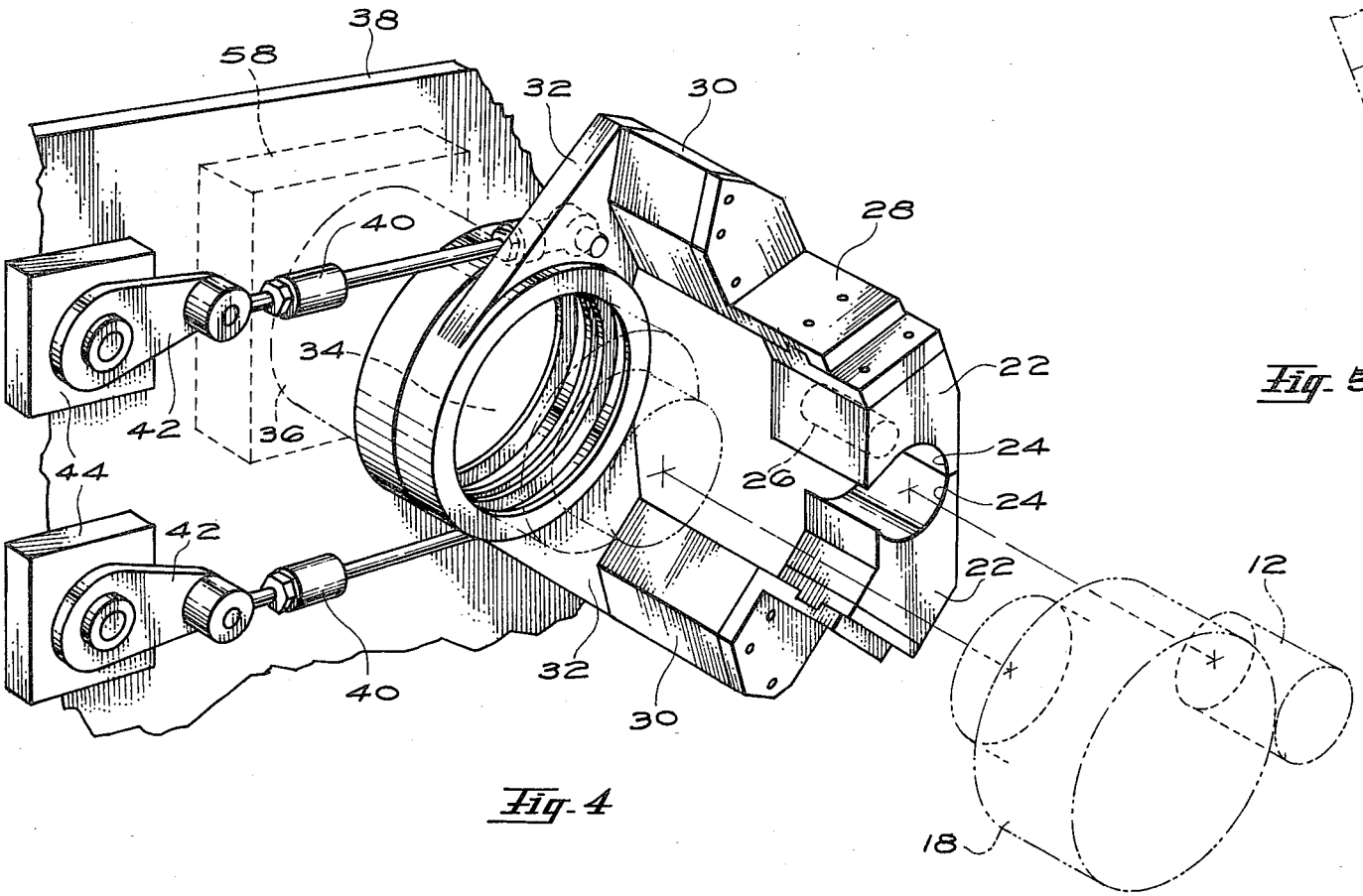
FIG. 4 is a perspective view of the cinch shoe mechanisms of FIG. 3 showing the builder roller and core in exploded form.

Web guide means are provided as shown in FIGS. 3, 4 and 5 for guiding the web end portion 20 around core 12 for cinching. The guide means comprise upper and lower arcuate cinch shoes 22 having guiding surfaces 24 spaced from and conforming to the periphery of the core. The upper shoe 22 further rotatably supports a spring biased roller 26 (FIGS. 4 and 5) for pressing the leading end 20 of the web into engagement with the periphery of the core. The upper and lower shoes 22 are secured via shoe brackets 28 and extenders 30 (FIGS. 3 and 4) to arms 32 which are pivotally mounted on bearing surfaces 34, shown dotted. The bearing surfaces 34 are on a post 36 coaxial with builder wheel 18 and cantilevered from an apparatus support frame 38. Shoes 22 are pivotally movable between a guiding position as seen in full lines in FIG. 3, and a retracted position shown in phantom. Each shoe 22 is moved by an adjustable arm 40 having one end pivotally secured to the shoe, and its opposite end pivotally mounted on a crank arm 42 which is supported and rotatably driven by a motor 44 mounted on frame 38 (FIG. 4).

Figure 7:
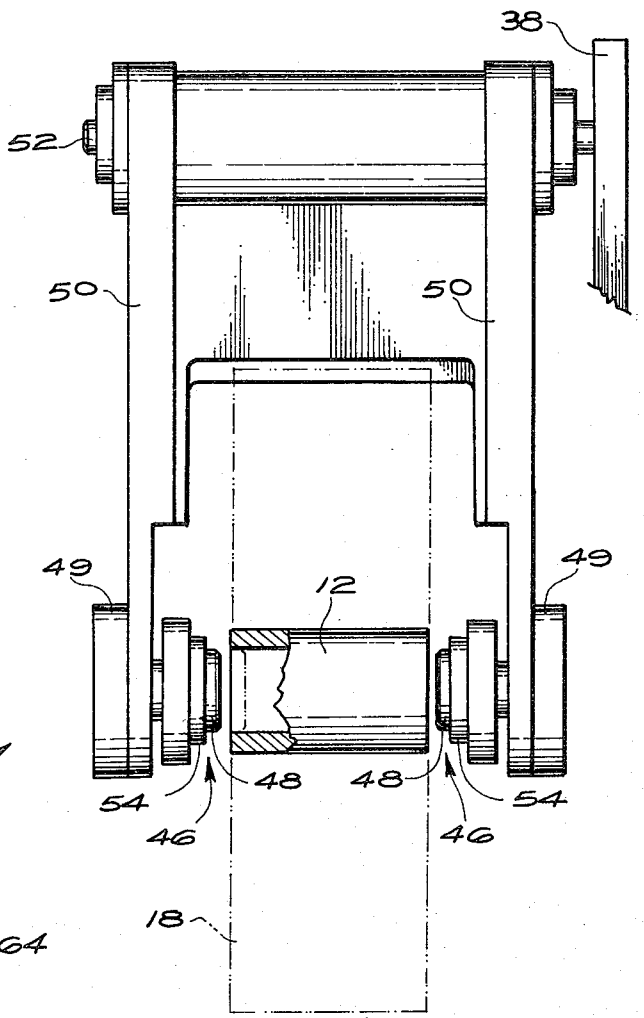
FIG. 7 is an enlarged end view taken from line 7—7 of the core feeding mechanism of FIG. 6.
Figure 6:
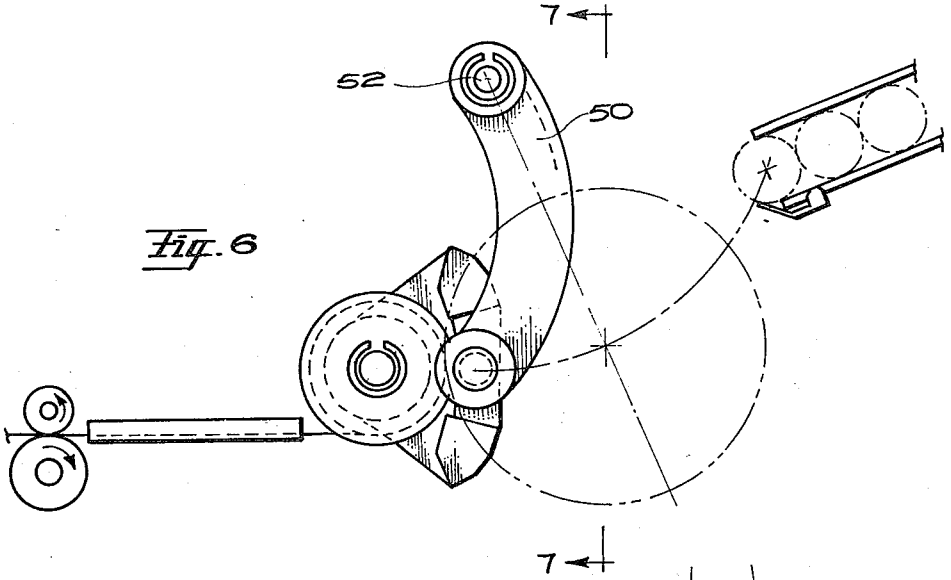
FIG. 6 is a segmental schematic side elevational view showing the core feeding mechanism.

The core driving means for center driving core 12 comprises core chucks 46, of known type, as best seen in FIGS. 1, 2, and 7, which are axially movable, in response to a fluid cylinder 49 or the like, for engaging and disengaging each end of the core. The core chucks 46 are preferably provided with axially movable gudgeons 48, shown in a disengaged position in FIG. 7, for releasably engaging ends of the core 12. Each core chuck 46 is rotatably supported at one end of a core support arm 50 (FIGS. 6 and 7), the opposite end of which is pivotally mounted on a spindle 52 extending from frame 38. Each core chuck 46 has a cylindrical rim 54 (FIGS. 1, 2, and 7) engageable with a flange in the form of an endless elastic or resilient tire 56 mounted on each end of the periphery of builder roller 18. The rims 54 are forced into frictional engagement with tires 56 by rotationally driving the arms 50, by any suitable means such as an air cylinder, not shown. A motor 58 of any suitable type is mounted on frame 38, as shown dotted in FIG. 4, and is coupled to builder roller 18 for rotatably driving it at a desired number of revolutions per minute. The roller 18 and tires 56 rotatably drive core chucks 46 for center driving core 12 at a predetermined peripheral speed in excess of the peripheral speed of a central cylindrical roll drive surface 60 of the builder roller 18 (FIGS. 1, 2, and 8) and the selected transport speed of web 10. The speed difference between the periphery of core 12 and web end portion 20, as web end portion 20 completes a single convolution and enters a nip 62 (FIG. 1) between the core periphery and web 10, results in a cinching or tightening of web end portion 20 on core 12. As indicated earlier, after cinching, the web is wound onto the core by builder roller 18. At such time overdriven clutches, not shown, coupled to pinch rollers 14, 16 are separated discontinuing any web drive from the pinch rollers.

Figure 8:
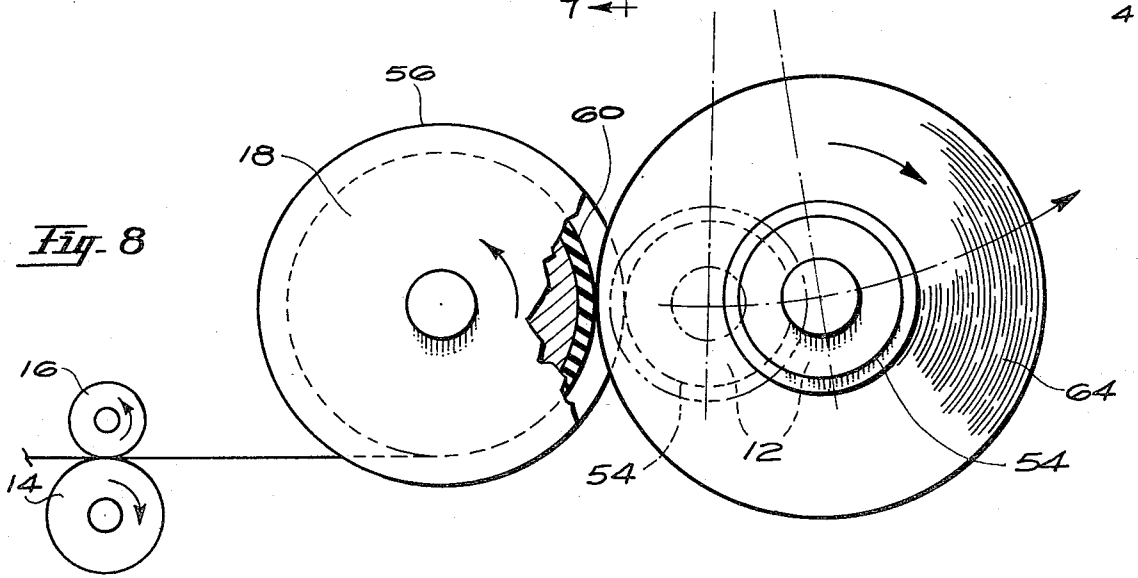
FIG. 8 is a view similar to FIG. 1 and partially in section showing the builder roller and core in a roll surface driving mode of operation.

Roll drive surface 60 of builder roller 18 has a diameter less than the diameter of a tire 56 as best seen in FIG. 2. As a result, in the normal position of builder roller 18, tires 56 are in driving engagement with rims 54 while roll drive surface 60 is spaced a predetermined clearance space "x" from the periphery of core 12. The web end portion 20 is initially transported through the clearance space and is directed by shoes 22 around the periphery of core 12 where it is cinched. The builder roller 18 center-drives the core through tires 56 and core chuck rims 54 until a sufficient number of web convolutions are wound on the core causing the diameter of roll 64 to exceed the outer core diameter plus twice the clearance space "x". At this point, the outer web convolution on roll 64 frictionally engages roll drive surface 60 which begins to surface drive the roll as best seen in FIG. 8. Substantially simultaneously, the outer web convolution of roll 64 gradually forces roll core 12 outwardly causing core driving tires 56 to disengage core chuck rims 54 and terminate center driving the core. The remaining web convolutions are wound onto roll 64 by surface winding the roll by means of the roll drive surface 60.

The invention has been described in detail with particular reference to a preferred embodiment, but it will be understood that variations and modifications can be effected within the spirit and scope of the invention as described. For example, the space "x" between the outer surface of core 12 and a roll drive surface 60 on builder roller 18 may be provided by controlling the position of the core support means 45, 50 by suitably arranged stop members, not shown. In such a modification builder roller 18 can drive core 12 through other means than rim 54 and tire 56 such as, for example, a belt trained over pulleys on the roller and core drive, not shown, or independent drive means, not shown, can be provided for builder roller 18 and core 12.

Another alternative way for providing the space "x" between the outer surface of core 12 and a roll drive surface 60 is to eliminate the drive flange or tire 56 on builder roller 18 and provide a core chuck rim 54 of larger diameter than the core. To drive the core surface at a speed in excess of the speed of the web to effect cinching, the outer core surface and roll drive surface 60 can be designed to run at substantially the same speed, and the web 10 advanced at a lower speed. Alternatively, rims 54 and tires 56 could be eliminated, and the builder roller 18 and core 12 provided with independent adjustable drive means, not shown.

What is claimed is:

1. Apparatus for automatically cinching the end portion of a web onto a cylindrical core and winding convolutions of web on the core to form a roll comprising:

means for transporting a web to said core at one speed;

means for guiding the end portion of the transported web around the outer periphery of said core;

core driving means adapted to be (1) drivingly engaged with said core in a first mode of operation for rotatably driving said core at an outer peripheral speed in excess of said one speed for automatically cinching the transported web end portion onto said core and winding convolutions of web onto the core to form a roll having a roll surface, and (2) drivingly disengaged from said core in a second mode of operation;

roll surface driving means adapted to be drivingly engaged with the roll surface in a first operating condition, and drivingly disengaged from the roll surface in a second operating condition, said roll surface driving means being in its second operating condition when said core driving means is in its first mode of operation; and means responsive to a predetermined roll surface diameter as web is wound on the roll for substantially simultaneously placing said core driving means in its second mode of operation and said roll surface driving means in its first operating condition.

2. The apparatus according to claim 1 wherein said guiding means comprises a pair of cinch shoes having guiding surfaces spaced from and substantially conforming to the peripheral surface of said core.

3. The apparatus according to claim 1 wherein said core has a circular member secured thereto, and said core driving means comprises a builder roller having a peripheral core drive surface for engaging and driving said circular member when said core driving means is in its first mode of operation.

4. The apparatus according to claim 3 wherein said core drive surface comprises an endless elastic tire mounted on the periphery of said builder roller.

5. The apparatus according to claim 4 wherein said roll surface driving means comprises a cylindrical roll drive surface on said builder roller.

6. The apparatus according to claim 5 wherein said core drive surface has a diameter greater than the diameter of said roll drive surface.

7. Apparatus for automatically cinching the end portion of a web onto a cylindrical core and winding convolutions of web on the core to form a roll comprising:

means for transporting a web to said core at one speed;

means for guiding the end portion of the transported web around the periphery of said core;

core driving means having (1) a core driving mode of operation for rotatably driving said core at an outer peripheral speed in excess of said one speed for automatically cinching the transported web end portion onto said core and winding web convolutions thereon to form a roll having a surface of increasing diameter, and (2) a core non-driving mode of operation in which said core driving means is out of driving engagement with said core;

roll surface driving means normally spaced a clearance distance from the outer surface of the core for drivingly engaging the roll surface after the web end portion has been cinched and the web convolutions on the core have built up the roll to a predetermined roll surface diameter; and means for substantially simultaneously placing said core driving means in its core non-driving mode of operation when said built-up roll reaches said predetermined roll surface diameter.

8. The cinching and winding apparatus according to claim 7 wherein said core driving means comprises a builder roller having a core drive surface radially spaced one distance from the builder roller axis.

9. The cinching and winding apparatus according to claim 8 wherein said core driving means further has means for drivingly coupling said core drive surface to said core when said core driving means is in its core driving mode of operation.

10. The cinching and winding apparatus according to claim 9 wherein said core drive surface comprises an endless elastic tire mounted on the periphery of said builder roller, and said coupling means comprises a core chuck secured to said core, a cylindrical chuck surface on said core chuck, and means for biasing said chuck surface into driving engagement with said tire.

11. The cinching and winding apparatus according to claim 8 wherein said roll surface driving means comprises a cylindrical roll drive surface on said builder roller radially spaced a lesser distance than said one distance from said builder roller axis to form said clearance distance between said roll drive surface and said core periphery when said core driving means is in its core driving mode of operation.

12. The cinching and winding apparatus according to claim 11 wherein said core drive surface comprises a pair of spaced endless elastic tires mounted on the periphery of said builder roller, and said core driving means has means for drivingly coupling the outer periphery of said tires to said core when said core driving means is in its core driving mode of operation, said coupling means comprising core chucks secured to opposite ends of said core, a cylindrical chuck surface on each of said core chucks in alignment with one of said tires, and means for biasing the outer periphery of said chuck surfaces into driving engagement with said tires.

13. A method for automatically cinching the end portion of a web onto a cylindrical core and winding convolutions of web on the core to form a roll comprising the steps of:

transporting a web to said core at one speed;

guiding the end portion of the transported web around the outer periphery of the core;

rotatably driving the core by means of a first surface on a builder roller at an outer peripheral speed in excess of said one speed for automatically cinching the transported web end portion onto the core and then winding a plurality of convolutions of web onto the core to form a roll having a roll surface; and substantially simultaneously discontinuing driving the core by disengaging the first surface of the builder roller from the core, and effecting roll surface driving by increasing the diameter of the roll until the roll surface and a second surface of the builder roller are in surface driving engagement.

14. A method according to claim 13 wherein the builder roller is mounted adjacent the core and the core driving step is achieved by first surfaces of the roller and core in driving engagement while second surfaces of the roller and core are spaced apart and disengaged from one another, and the steps of simultaneously discontinuing driving the core and effecting surface driving are achieved by simultaneously disengaging the first surfaces of the roller and core, and engaging the second surface of the roller and the roll surface in response to an increase in the roll surface diameter.

15. A method according to claim 13 wherein the core has a first cylindrical member secured to one end thereof, and the builder roller is mounted adjacent and parallel to the core and the first and second builder roller surfaces are cylindrical, and the core driving step is achieved when the first cylindrical roller surface is in driving engagement with the first cylindrical member and the second cylindrical roller surface is disengaged from the peripheral surface of the core, and the steps of simultaneously discontinuing driving the core and effecting roll surface driving are achieved by simultaneously disengaging the first cylindrical roller surface from the first cylindrical member, and engaging the second cylindrical roller surface with the roll surface in response to an increase in the roll surface diameter.

* * * * *